US010463120B2

(12) United States Patent
De Iuliis et al.

(10) Patent No.: US 10,463,120 B2
(45) Date of Patent: Nov. 5, 2019

(54) WEARABLE BAND HAVING INCREMENTAL ADJUSTMENT MECHANISMS

(71) Applicant: Apple Inc., Cupertino, CA (US)

(72) Inventors: Daniele De Iuliis, Cupertino, CA (US); Ryan C. Perkins, Cupertino, CA (US); Michael J. Webb, Scotts Valley, CA (US)

(73) Assignee: APPLE INC., Cupertino, CA (US)

( * ) Notice: Subject to any disclaimer, the term of this patent is extended or adjusted under 35 U.S.C. 154(b) by 432 days.

(21) Appl. No.: 15/264,528

(22) Filed: Sep. 13, 2016

(65) Prior Publication Data

US 2017/0086535 A1 Mar. 30, 2017

Related U.S. Application Data

(60) Provisional application No. 62/234,867, filed on Sep. 30, 2015.

(51) Int. Cl.
*A44C 5/00* (2006.01)
*A44C 5/24* (2006.01)

(52) U.S. Cl.
CPC ..... *A44C 5/246* (2013.01)

(58) Field of Classification Search
CPC ..... A44C 5/246
USPC ..... 224/175
See application file for complete search history.

(56) References Cited

U.S. PATENT DOCUMENTS

| | | | | |
|---|---|---|---|---|
| 1,692,079 | A | 11/1928 | D'Alo | |
| 1,817,475 | A * | 8/1931 | Becker | A44C 5/22 224/176 |
| 4,197,618 | A | 4/1980 | Bourguignon | |
| 4,414,714 | A * | 11/1983 | Kostanecki | A44C 5/20 224/175 |
| 4,941,236 | A | 7/1990 | Sherman et al. | |
| 6,301,754 | B1 | 10/2001 | Grunberger et al. | |
| 6,799,887 | B1 | 10/2004 | Kinney | |
| 7,363,687 | B2 | 4/2008 | Kraus et al. | |
| 7,562,640 | B2 | 7/2009 | Lalor | |
| 7,690,220 | B2 | 4/2010 | Okamura | |
| 8,562,489 | B2 | 10/2013 | Burton et al. | |

(Continued)

FOREIGN PATENT DOCUMENTS

| | | |
|---|---|---|
| CN | 2862782 | 1/2007 |
| CN | 201683167 | 12/2010 |

(Continued)

*Primary Examiner* — Peter N Helvey
(74) *Attorney, Agent, or Firm* — Morgan, Lewis & Bockius LLP

(57) ABSTRACT

A wearable band may be coupled with an electronic device, and a user can secure the electronic device around a body part of the user with an attachment mechanism of the wearable band. The wearable band and/or the attachment mechanism can include an incremental adjustment mechanism. The attachment mechanism can produce an initial fit or tightness when the wearable band is secured around the body part of the user. The incremental adjustment mechanism can be used to incrementally adjust the initial fit of the wearable band on the body part. The incremental adjustment mechanism is configured to allow the user to adjust the fit or tightness of the wearable band around the body part more finely than the attachment mechanism.

10 Claims, 10 Drawing Sheets

(56) References Cited

U.S. PATENT DOCUMENTS

| | | | | |
|---|---|---|---|---|
| 8,769,844 | B2 | 7/2014 | Beers et al. | |
| 8,787,006 | B2 | 7/2014 | Golko et al. | |
| 8,997,318 | B2 | 4/2015 | Nicolas et al. | |
| 9,298,882 | B2 | 3/2016 | Proud | |
| 9,551,405 | B1 * | 1/2017 | Chen | F16H 19/04 |
| 9,639,057 | B2 * | 5/2017 | Jung | G04B 37/0008 |
| 2003/0229974 | A1 | 12/2003 | Zemer et al. | |
| 2006/0196021 | A1 | 9/2006 | Touzov et al. | |
| 2007/0167106 | A1 | 7/2007 | Hoover | |
| 2008/0184737 | A1 | 8/2008 | Wiseman | |
| 2009/0010110 | A1 | 1/2009 | Chariton | |
| 2009/0049667 | A1 * | 2/2009 | Takahashi | A44C 5/243 24/71 J |
| 2012/0044031 | A1 | 2/2012 | Ninomiya et al. | |
| 2012/0102691 | A1 * | 5/2012 | Han | A44B 11/008 24/68 J |
| 2013/0205476 | A1 | 8/2013 | Gentile et al. | |
| 2013/0326790 | A1 | 12/2013 | Cauwels et al. | |
| 2016/0007697 | A1 | 1/2016 | de Jong | |
| 2016/0132023 | A1 * | 5/2016 | Jung | G04B 37/0008 368/282 |

FOREIGN PATENT DOCUMENTS

| | | |
|---|---|---|
| CN | 201846934 | 6/2011 |
| CN | 201869909 | 6/2011 |
| CN | 202233407 | 5/2012 |
| CN | 102488365 | 6/2012 |
| JP | S59186504 | 3/2007 |
| JP | 2010207411 | 9/2010 |
| KR | 20042088200 | 7/2006 |
| KR | 20080000609 | 4/2008 |
| WO | WO2012/160195 | 11/2012 |

* cited by examiner

WEARABLE BAND HAVING INCREMENTAL ADJUSTMENT MECHANISMS

CROSS-REFERENCE TO RELATED APPLICATION(S)

This application is a nonprovisional patent application of and claims the benefit of U.S. Provisional Patent Application No. 62/234,867, filed Sep. 30, 2015 and titled "Wearable Band Having Incremental Adjustment Mechanisms," the disclosure of which is hereby incorporated herein by reference in its entirety.

FIELD

The described embodiments relate generally to wearable bands. More particularly, the present embodiments relate to wearable bands that include incremental adjustment mechanisms.

BACKGROUND

Users frequently encounter a variety of different electronic devices in the modern world. Such electronic devices include computers, media players, entertainment systems, displays, communication systems, and so on. Many electronic devices, such as laptop computers, tablet computers, and smart phones, are portable. Some of these portable electronic devices may be configured to be worn by a user. In some cases, a wearable electronic device includes one or more bands, straps, or other attachment devices that may be used to attach the wearable electronic device to a body part of a user. For example, a wrist worn wearable electronic device may include a band that can be used to secure the wearable electronic device to a user's wrist.

A band used to secure the wearable electronic device may not attach the electronic device to the body part as tightly as desired or needed. For example, an electronic device may be able to shift on or slide around the body part while attached to the body part. Additionally or alternatively, the band may be sufficiently loose on the body part such that one or more components (e.g., sensors) in the electronic device may not be able to operate, or may not function as well, due to the loose fit of the band on the body part.

SUMMARY

In one aspect, a wearable band is configured to couple with an electronic device, such as a health assistant or a watch. The wearable band includes a first band segment, a second band segment, and an attachment mechanism configured to couple the first and second band segments together. The second band segment can include a first band sub-segment and a second band sub-segment. An incremental adjustment mechanism may be operably connected to at least one of the first band sub-segment and the second band sub-segment. When the wearable band is secured to a body part of a user, the attachment mechanism produces a first band tightness around the body part. The incremental adjustment mechanism is configured to move one band sub-segment with respect to other band sub-segment to incrementally adjust the first tightness of the band to a second tightness.

In another aspect, a wearable band includes a folding clasp coupled to a first band segment and to a second band segment. The folding clasp is configured to open and close when a user secures the wearable band to a body part. One example of a folding clasp is a single deployant clasp. The folding clasp produces a first band tightness for the band around the body part when the folding clasp is closed. An incremental adjustment mechanism is included in the folding clasp. The incremental adjustment mechanism comprises a button configured to open the folding clasp when pushed and to adjust a spacing between the first and the second band segments to incrementally adjust the first band tightness to a second band tightness.

In yet another aspect, a wearable band can include an expandable clasp, such as a butterfly clasp. The expandable clasp includes two top segments coupled to two bottom segments. A respective top segment is connected to a first band segment and a second band segment. The expandable clasp is configured to open and close when a user secures the wearable band to a body part. The two top segments fold down onto two bottom segments when the clasp is closed. The expandable clasp produces a first band tightness for the band around the body part when the folding clasp is closed. An incremental adjustment mechanism is coupled to the two bottom segments and configured to move with respect to each other to incrementally adjust the first band tightness to a second band tightness.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
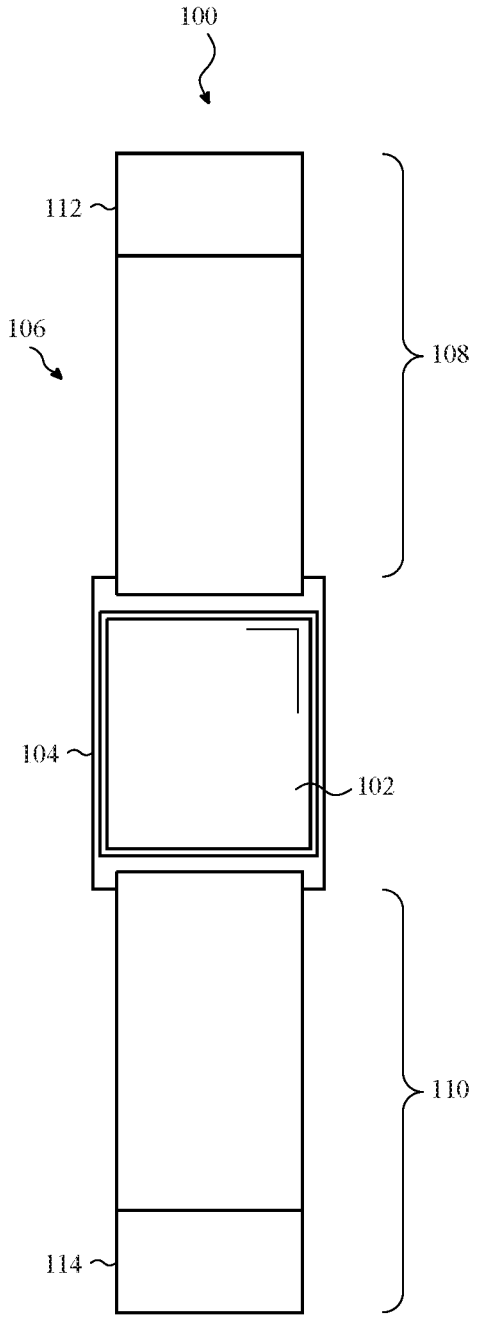
FIG. 1 shows a plan view of an electronic device coupled to a band.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a wearable band that attaches to a body part of a user using an attachment mechanism. The wearable band and/or the attachment mechanism can include an incremental adjustment mechanism. The incremental adjustment system permits a user to have much finer control over the fit of a band than is provided by a typical band. This can lead to increased comfort when the user is wearing the band. This increased comfort can result in a user wearing the electronic device for longer periods of time, which may bring attendant benefits dependent on the functions of the device. For example, a user may be able to operate one or more health monitoring applications or functions for a longer period of time.

The incremental adjustment mechanism is configured to allow the user to adjust the fit or tightness of the wearable band more finely than the attachment mechanism. The attachment mechanism can produce an initial fit or tightness and the incremental adjustment mechanism can adjust the initial tightness. In other words, a user can use the attachment mechanism to select a first band tightness or a second band tightness. The incremental adjustment mechanism is configured to adjust the chosen first or second band tightness by a fraction of the difference between the first and second band tightnesses.

In some embodiments, the incremental adjustment of a wearable band can be done before a user secures the band to a body part. In other embodiments, the incremental adjustment of the wearable band may be done while a user is wearing the band on the body part. This "on-the-fly" incremental adjustment allows a user to change the tightness of a band at various times during a day based on comfort and/or activity. For example, a user may want a slightly tighter fit when exercising so a health sensor (e.g., heart rate monitor) can operate more effectively. However, at other times of the day the user may want a looser fit. Several techniques are disclosed for performing incremental adjustments.

In a first example embodiment, a wearable band includes two band segments that are configured to couple together with the attachment mechanism. One of the band segments includes two band sub-segments that are operably coupled together with the incremental attachment mechanism. The incremental attachment mechanism is configured to move one band sub-segment with respect to the other band sub-segment, or to move both band sub-segments to incrementally adjust the tightness of the band. In one non-limiting example, the two band sub-segments each include a toothed edge. The toothed edges are positioned opposite one another. A rotatable gear is positioned between the two toothed edges. A dial is attached to the gear and a user turns the dial to incrementally adjust the tightness of the band when the wearable band is attached to the body part of the user. As one example, the user can rotate the dial in a clockwise direction to loosen the tightness of the wearable band, or the user can rotate the dial in a counter-clockwise direction to increase the tightness of the wearable band around the body part.

In a second example embodiment, the first band segment can include a post that couples with an opening in the second band segment. The post is movable between at least two positions on the first band segment. For example, the post may rotate from a first position to a second position to incrementally adjust the tightness of the band. Alternatively, the post may slide or shift from the first position to the second position. In one embodiment, the post may be positioned at only two positions. In another embodiment, the post can be positioned at three or more different positions (e.g., post can be positioned at 0 degrees, 90 degrees, and 180 degrees along a half circle).

In some embodiments, a user can select a post from multiple posts connected to the first band segment to couple with an opening in the second band segment. As one example, the posts may rotate from a first position to a second position to position the selected post in a location to couple with the opening. For example, one post may be positioned to couple with the opening at the first position and another post can be positioned to couple with the opening at the second position. The multiple posts can have different dimensions (e.g., round posts with different diameters). A user may incrementally adjust the tightness of the band by selecting a post having a particular diameter and positioning that post to couple with an opening in the second segment of the wearable band.

In other embodiments, the incremental adjustment is done prior to a user attaching the wearable band to a body part. In one example embodiment, a continuous wearable band can include a foldable and unfoldable attachment mechanism. One example of a foldable and unfoldable attachment mechanism is a single deployant clasp. With a single deployant clasp, a first wing of the band folds down onto a second wing of the band and couples to the second wing. To uncouple the first and second wings, a user can pull up or press one or more buttons to release the first wing from the second wing.

Alternatively, another example of a foldable and unfoldable attachment mechanism is an expandable clasp such as a butterfly clasp. With a butterfly clasp, two top segments of the band unfold from (open) and fold down onto (closed) two bottom segments. An incremental adjustment mechanism can be included in the attachment mechanism or in the continuous band. As one example, when the butterfly clasp is open, at least one bottom segment moves with respect to the other segment to incrementally adjust the tightness of the band. A plate can attached to both bottom segments with fasteners (e.g., screws) to secure the two bottom segments together when the band is at a desired length. As one example, the bottom segments can be coupled together with a tongue and groove joint that allows one or both bottom segments to slide closer together or farther apart.

These and other embodiments are discussed below with reference to FIGS. 1-18. However, those skilled in the art will readily appreciate that the detailed description given herein with respect to these Figures is for explanatory purposes only and should not be construed as limiting.

FIG. 1 illustrates a plan view of an electronic device coupled to a band. The electronic device is depicted as a smart watch, but other embodiments are not limited to such a device. Any suitable electronic device may be coupled to a wearable band. Example electronic devices include, but are not limited to, a digital music player, a health monitoring device, a smart telephone, and any other suitable electronic device that can attach to a body part of a user with a band.

The wearable electronic device 100 can include a display 102 at least partially surrounded by an enclosure 104. In some embodiments, the display 102 may incorporate an input device configured to receive touch input, force input, temperature input, and the like. The display 102 can be implemented with any suitable display, including, but not limited to, a multi-touch sensing touchscreen device that uses liquid crystal display (LCD) technology, light emitting diode (LED) technology, organic light-emitting display (OLED) technology, or organic electro luminescence (OEL) technology. The display 102 can have any given size and be located substantially anywhere on the electronic device 100.

The enclosure 104 can be formed of one or more components operably connected together, such as a front piece and a back piece. Alternatively, the enclosure 104 can be formed of a single piece operably connected to the display 102. The enclosure 104 can be formed of any suitable material, including, but not limited to, plastic and metal. In the illustrated embodiment, the enclosure 104 is formed into a substantially rectangular shape, although this configuration is not required.

The enclosure 104 can form an outer surface or partial outer surface for the internal components of the electronic device 100. For example, the electronic device 100 can include internal components such as a processing device operably connected to a memory, one or more sensors, one or more communication interfaces, output devices such as displays and speakers, one or more input devices, a power supply (e.g., a battery), and a health monitoring system. The communication interface(s) can provide electronic communications between the communications device and any external communication network, device or platform, such as but not limited to wireless interfaces, Bluetooth interfaces, USB interfaces, Wi-Fi interfaces, TCP/IP interfaces, network communications interfaces, or any conventional communication interfaces.

The sensor(s) may be configured to sense substantially any type of characteristic, such as but not limited to, images, pressure, light, touch, force, temperature, position, motion, and so on. For example, the sensor(s) may be an image sensor, a temperature sensor, a light or optical sensor, an atmospheric pressure sensor, a proximity sensor, a force sensor, a humidity sensor, a magnet, a gyroscope, an accelerometer, and so on.

The health monitoring system can be configured to detect, measure, or determine any suitable health parameter of a user. For example, a health monitoring system may determine a heart rate or pulse of the user, the blood pressure, and/or an amount of calories expended based on an activity. The health monitoring system, in conjunction with a communication interface, may transmit or receive health, fitness, and/or wellness data or information to or from a website or another electronic device, such as a smart telephone or tablet computing device.

The electronic device 100 is attached to a band 106. In some embodiments, the electronic device 100 is permanently attached to the band. In other embodiments, the electronic device 100 can be detachable from the band 106. As one example, the ends of the band 106 proximate to the electronic device 100 can slide in and out of grooves formed in the ends of the electronic device 100.

In the illustrated embodiment, the band includes two band segments 108, 110 that couple together when a user attaches the band to a body part (e.g., a wrist). An attachment mechanism 112, 114 at the distal ends of the band segments 108, 110, respectively, are configured to couple to each other. Any suitable type of attachment mechanism(s) can be used. For example, in one embodiment the attachment mechanism 112 is a post and the attachment mechanism 114 is one or more openings that receive the post. In another embodiment, the attachment mechanism 114 can be an opening that receives the distal end of the band segment 108. Once the distal end is through the opening, the distal end of the band segment 108 can fold over and secure to another section of the band segment 108. For example, both the distal and other section of the band segment 108 may include magnets that couple together when the band segment 108 is folded onto itself.

In some embodiments, the band 106 includes only one attachment mechanism. As one example, the attachment mechanism 114 can be an opening that receives the distal end of the band segment 108 and positions the distal end of the band segment 108 between the body part and the band segment 110. Alternatively, the band 106 can be a continuous band (no segments) and the attachment mechanism can expand to allow a user to attach the band to a body part and then collapse once the band is at a desired location on the body part. For example, a butterfly clasp or a single deployant clasp can be used as an attachment mechanism.

The one or more attachment mechanisms 112, 114 can operate as a coarse adjustment in that the user is able to attach the band to a body part, but the band may not be attached as tightly to the body part as desired or needed. For example, a band may be able to shift on the body part (e.g., wrist) or slide around the body part while attached to the body part. Additionally or alternatively, the band may be sufficiently loose on the body part such that one or more components (e.g., sensors) in the electronic device 100 and/or in the band 106 may not be able to operate, or may not function as well due to the band's loose fit on the body part.

As one example, a photoplethysmogram (PPG) sensor may be located at the bottom surface of the electronic device 100 (the surface that is near or contacts the body part of the user). The PPG sensor emits light toward the body part and receives a portion of the light that reflects back toward the sensor. If the band 106 is too loose, the PPG sensor may not be able to determine a health measurement (e.g., pulse rate) for a user. Alternatively, the movement of the band 106 can create motion artifacts in the signals used to determine a health measurement, which can cause errors in the health measurement.

Example embodiments are described herein that include an incremental adjustment mechanism that can be separate from an attachment mechanism or may be included in an attachment mechanism. The attachment mechanism can produce an initial fit or tightness and the incremental adjustment mechanism can adjust the initial tightness. The incremental adjustment mechanism is configured to allow a user to adjust the length, fit, or tightness of the wearable band more finely than the attachment mechanism. Various example incremental adjustment mechanisms are described in conjunction with FIGS. 2-18.

Figure 2:
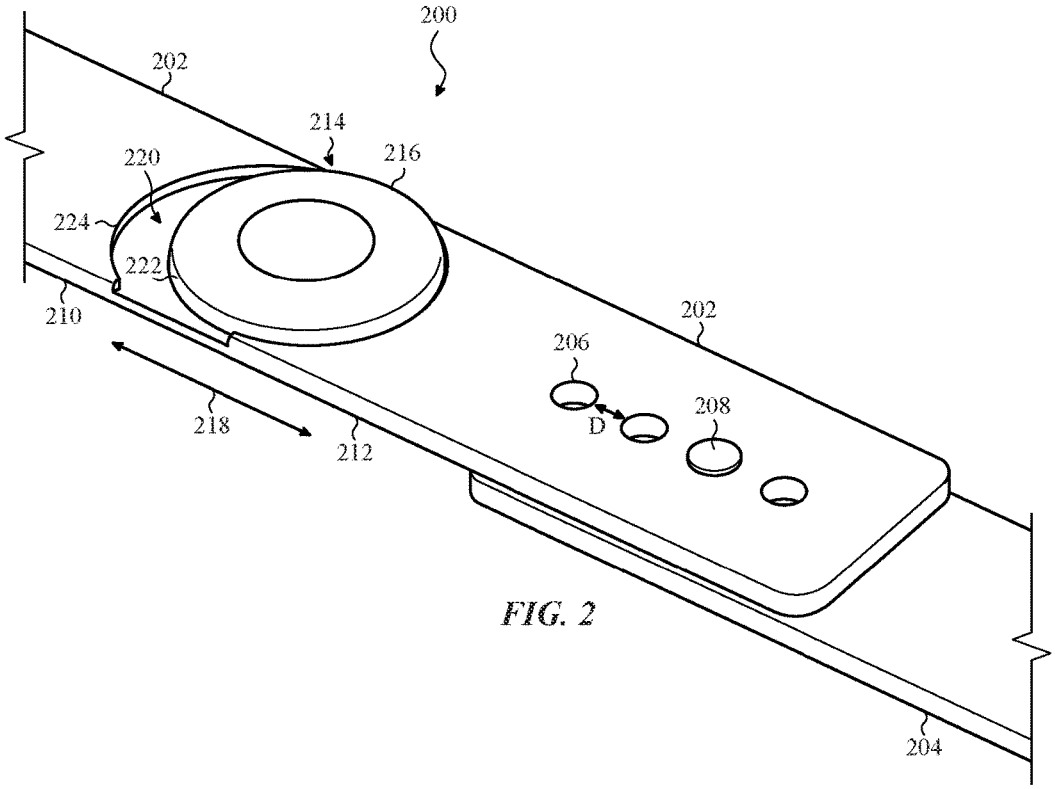
FIG. 2 shows one example of an attachment mechanism and an incremental adjustment mechanism for a wearable band.

FIG. 2 illustrates one example of an attachment mechanism and an incremental adjustment mechanism for a wearable band. The wearable band 200 includes a first band segment 202 and a second band segment 204. The attachment mechanism on the first band segment 202 includes multiple openings 206, and the attachment mechanism on the second band segment 204 is a post 208 that couples with (e.g., inserts into) one of the openings 206.

The first band segment 202 includes a first band sub-segment 210 and a second band sub-segment 212. An incremental adjustment mechanism 214 is configured to move at least one band sub-segment with respect to the other band sub-segment to increase or decrease the tightness of the band. In one embodiment, the first and second band sub-segments 210, 212 are coupled together and cannot be separated from one another. In another embodiment, the first and second band sub-segments 210, 212 can be disassembled from one another.

By turning the dial 216 clockwise or counter-clockwise, one or both band sub-segments 210, 212 move in one of two directions as shown by arrow 218. Moving the band sub-segments 210, 212 closer together reduces the size of the gap 220 (down to a minimum size) and incrementally increases the tightness of the band, while moving the band sub-segments 210, 212 farther apart increases the size of the gap 220 (up to a maximum size) and incrementally decreases the tightness of the band. In the illustrated embodiment, the minimum size of the gap 220 is reached when the edge 222 of the dial 216 contacts or nearly contacts the edge 224 of the first band sub-segment 210. The maximum size of the gap 220 can be determined in one of several ways. For example, the dial 216 can have a limited rotation distance, which in turn limits the separation distance between the two band sub-segments 210, 212. Additionally or alternatively, the maximum size of the gap 220 may be based on the distance D between two of the openings 206. For example, the maximum size of the gap 220, and therefore the maximum achievable separation distance between the two band sub-segments 210, 212, can be a fraction of the distance D (e.g., 50% of D).

Figure 3:
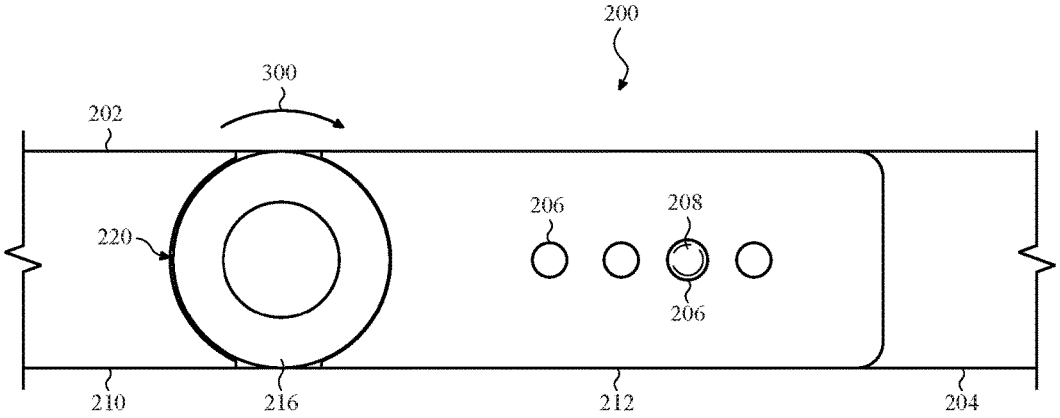
FIG. 3 shows the band sub-segments at a first position.
Figure 4:
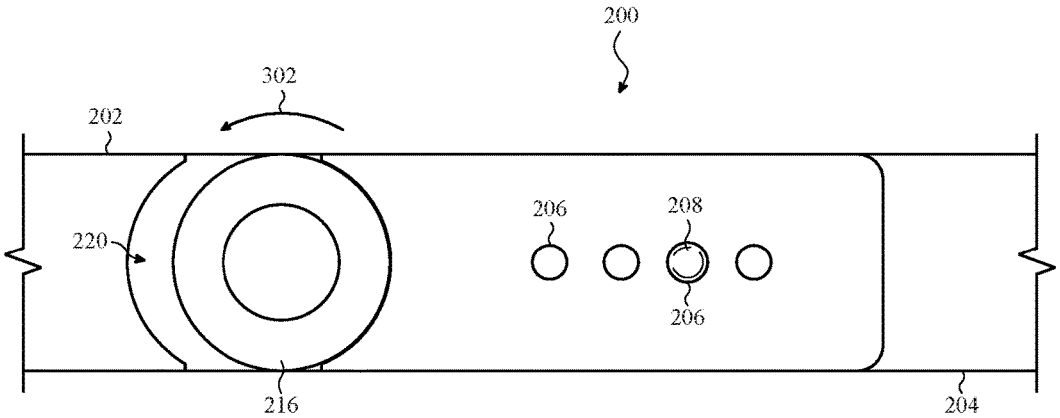
FIG. 4 shows the band sub-segments at a second position.

FIGS. 3 and 4 depict the band sub-segments 210, 212 in two different positions. As shown in FIG. 3, the first and second band sub-segments 210, 212 are close together in a first position. In one example, one or both of the first and second band sub-segments 210, 212 move(s) to a different second position (move farther apart) when the dial 216 is turned in a first direction (e.g., clockwise as shown by arrow 300), which increases the size of the gap 220 and decreases the tightness of the band 200 (see FIG. 4). Conversely, when the dial 216 is turned in a second direction (e.g., counter-clockwise as shown by arrow 302), one or both of the first and second band sub-segments 210, 212 move(s) closer together to a different third position, which decreases the size of the gap 220 and increases the tightness of the band 200 (e.g., change from FIG. 4 back to FIG. 3). Movement of one or both band sub-segments 210, 212 does not affect the attachment of the first and second band segments 202, 204. The attachment mechanisms 206, 208 remain securely coupled together while the first and/or second band sub-segments 210, 212 move.

Figure 5:
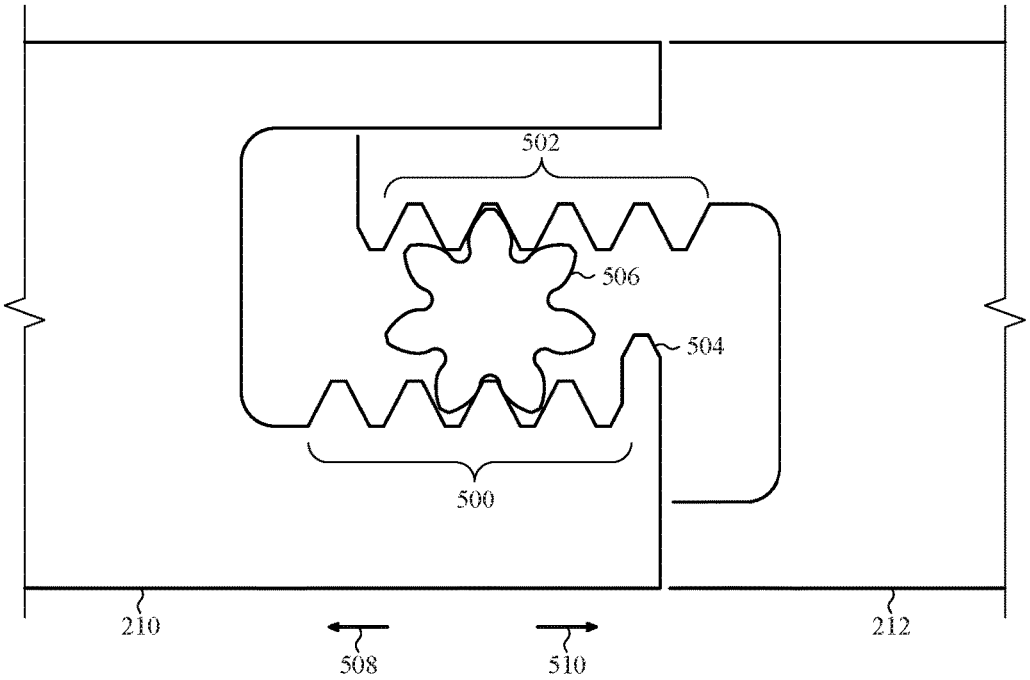
FIG. 5 shows one example of an incremental adjustment mechanism that is suitable for use in the incremental adjustment mechanism shown in FIGS. 2-4.

FIG. 5 shows one example of an incremental adjustment mechanism that is suitable for use in the incremental adjustment mechanism shown in FIGS. 2-4. The dial 216 is removed so that the incremental adjustment mechanism is visible. The first and second band sub-segments 210, 212 each include a toothed edge 500, 502, respectively. The toothed edges are positioned opposite one another. At least one tooth (e.g., tooth 504) at the end of a toothed edge can be enlarged to act as a stop mechanism for a rotatable gear 506. The first and second band sub-segments 210, 212 move based on the rotation direction of the gear 506. For example, if the gear 506 is rotated in a clockwise direction, the first and second sub-segments 210, 212 move farther apart. As shown, band sub-segment 210 moves in the direction of arrow 508 and band sub-segment 212 moves in the direction of arrow 510 when the gear 506 is rotated in a clockwise direction. Thus, the rotation of the gear 506 translates into linear motion of the band sub-segments 210, 212. Alternatively, if the gear 506 is rotated in a counter-clockwise direction, the first and second sub-segments 210, 212 move closer together (band sub-segment 210 moves in the opposite direction of arrow 508 and band sub-segment 212 moves in the opposite direction of arrow 510).

Figure 6:
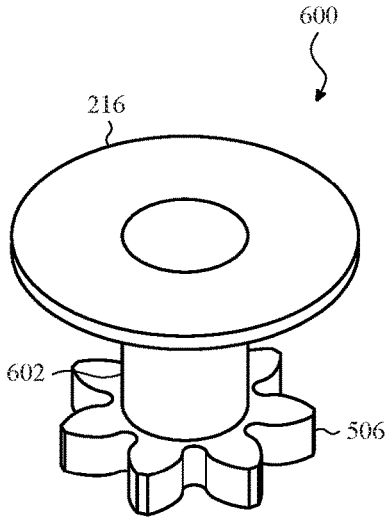
FIG. 6 shows one example of a gear assembly that is suitable for use in the incremental adjustment mechanism shown in FIG. 5.

FIG. 6 illustrates one example of a rotatable gear assembly that is suitable for use in the incremental adjustment mechanism shown in FIG. 5. The rotatable gear assembly 600 includes the dial 216 connected to the gear 506 by a connector 602. Rotation of the dial 216 causes the gear 506 to rotate in a similar direction.

Other embodiments can configure the incremental adjustment mechanism differently. As one example, the dial 216 can be configured to move only a single band sub-segment. Alternatively, an eccentric cam apparatus may be configured to move one band sub-segment with respect to the other band sub-segment.

In the embodiments shown in FIGS. 2-6, the band sub-segments 210, 212, the dial 216, the gear 506, and the connector 602 can each be made of any suitable material. For example, the band sub-segments 210, 212 may be made of a rigid or flexible material or combination of materials, such as metal, leather, ceramic, and plastic. If the band sub-segments 210, 212 are made of a flexible material, the toothed edges 502, 504 can be made of a more rigid material. The dial 216, the gear 506, and the connector 602 can be made of the same rigid material(s) or of different rigid materials. For example, the dial 216, the gear 506, and the connector 602 may each be made of a metal, ceramic, or plastic.

Figure 7:
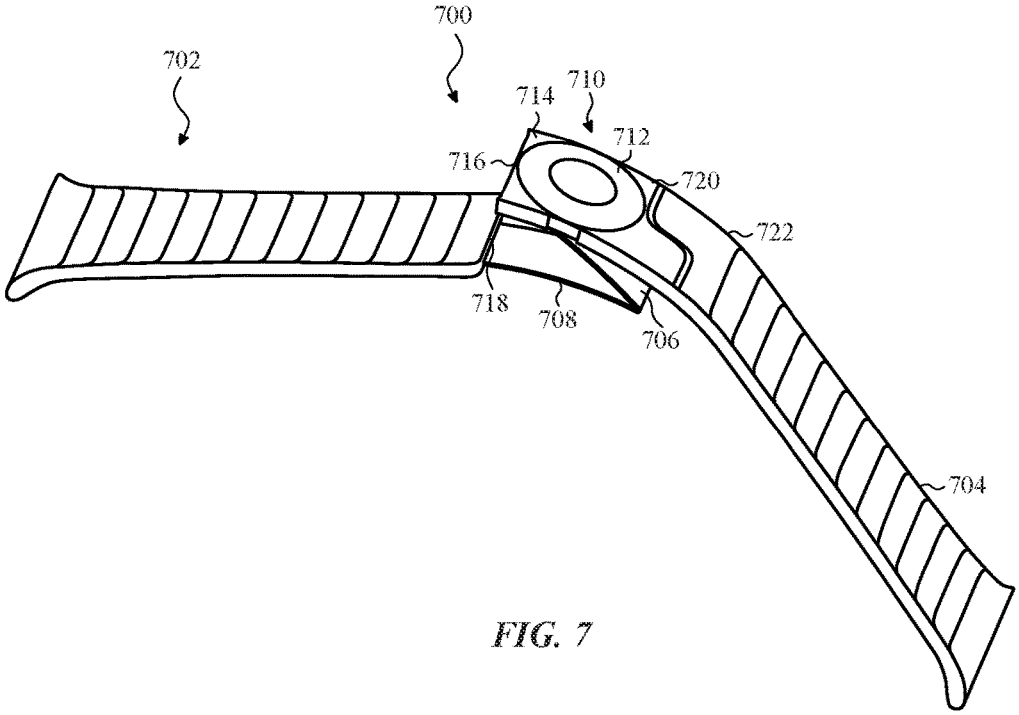
FIG. 7 shows another example of an attachment mechanism and an incremental adjustment mechanism for a wearable band.

FIG. 7 shows another example of an attachment mechanism and an incremental adjustment mechanism for a wearable band. The illustrated attachment mechanism 700 is known as a single deployant clasp. The wearable band 702 is a continuous band that can include multiple links 704 connected together. In other embodiments, the band can be made as a solid band without links. The band 702 can be made of any suitable material, including metal, plastic, leather, or various combinations thereof.

The attachment mechanism 700 unfolds or opens to position the band 702 on a user's body part (e.g., wrist). The user folds or closes the attachment mechanism 700 to secure to the band on the body part. The attachment mechanism 700 includes a first wing 706 that rotates (e.g., folds and unfolds) with respect to a second wing 708 when the attachment mechanism 700 closes and opens, respectively. An incremental adjustment mechanism 710 includes a dial 712 positioned in a top segment 714 of the attachment mechanism 700. In one embodiment, the dial 712 can be configured to open the attachment mechanism 700 by pressing downward on the dial 712. For example, a tab (not shown) that extends out from the edge 716 of the top segment 714 may engage with an opening (not shown) in the edge 718 of the band 702 when the attachment mechanism 700 is closed. The tab can retract out of the opening when the dial 712 is pushed downward.

Figure 8:
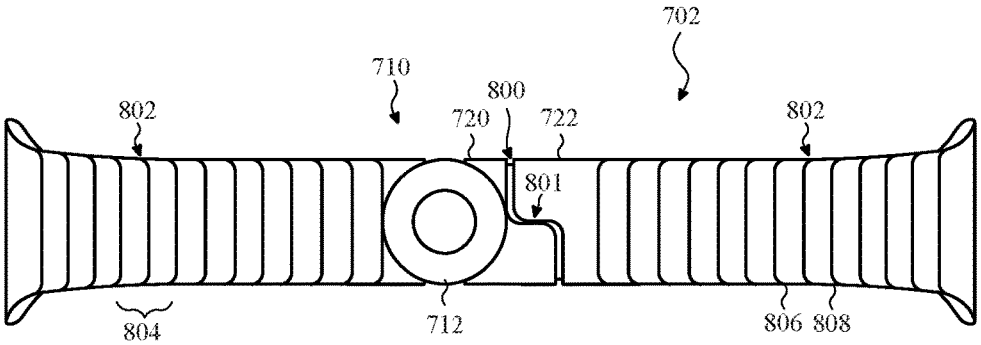
FIG. 8 shows the clasp in a closed position with the incremental adjustment mechanism at a first position.

The top segment 714 includes two band sub-segments 720, 722 that are configured to move relative to one another. The incremental adjustment mechanism 710 is configured to move at least one band sub-segment to increase or decrease the tightness of the band 702. FIG. 8 shows the clasp in a closed position with the incremental adjustment mechanism 710 at a first position. By turning the dial 712 clockwise or counter-clockwise, one or both band sub-segments 720, 722 move closer together or farther apart. Moving the band sub-segments 720, 722 closer together reduces the size of the gap 800 (down to a minimum size) and increases the tightness of the band 702, while moving the band sub-segments 720, 722 farther apart increases the size of the gap 800 (up to a maximum size) and decreases the tightness of the band 702.

As shown in FIG. 8, the gap 800 is arranged in an "s" shape to permit the two sub-segments 720, 722 to be co-planar and maintain continuity in the top surface of the two-segments 720, 722 (see area 801). Other embodiments can configure the gap 800 differently. For example, a gap can be arranged in a straight line across the width of the band 702. Alternatively, in some embodiments one sub-segment can rest on top of the other sub-segment when the attachment mechanism is closed.

Any suitable type of incremental adjustment mechanism may be used. For example, in one embodiment, the incremental adjustment mechanism shown in FIGS. 5 and 6 can be used in the embodiment of FIGS. 7 and 8. Additionally or alternatively, a gap 802 between one or more pairs of links 804 can increase or decrease when the dial 712 is turned. In some embodiments, the gaps 802 between adjacent links 806, 808 can change size equally over the length of the band 702. Alternatively, the gaps 802 between adjacent links 806, 808 can change size in differing amounts over the length of the band 702. In some embodiments, the gaps 802 between adjacent links 806, 808 in only a section of the band 702 (or in multiple sections) can change size (equally or unequally) over the length of the band 702.

Figure 9:
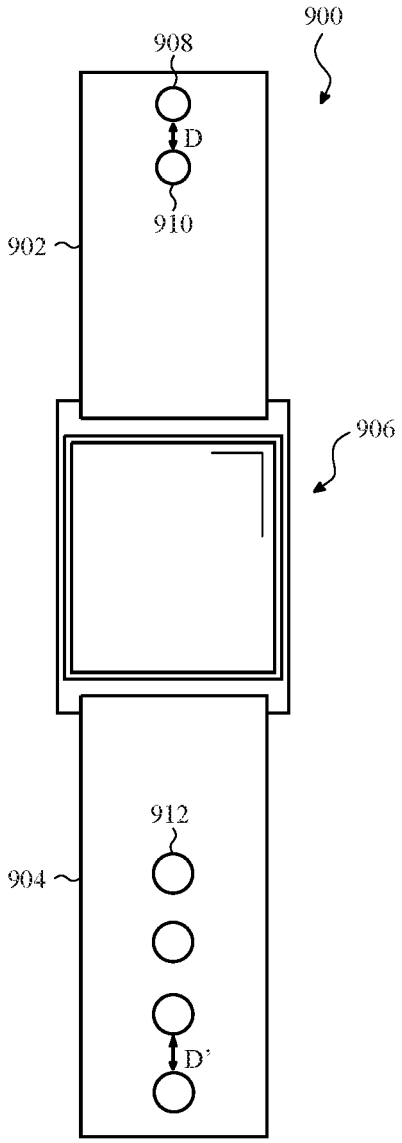
FIG. 9 shows a plan view of another example of an attachment mechanism for a wearable band.

FIG. 9 illustrates a plan view of another example of an attachment mechanism for a wearable band. Like the embodiment shown in FIG. 2, the band 900 includes a first band segment 902 and a second band segment 904 attached to an electronic device 906. The attachment mechanism includes a first post 908 and a second post 910 offset from one another by a distance D and connected to the distal end of the first band segment 902, and multiple openings 912 formed in a distal end of the second band segment 904. In some embodiments, the unused post can be depressed into the first band segment 902 to reduce the height of the unused post. The post that couples with a respective opening 912 can be pulled up to extend out from the top surface of the first band segment 902.

The incremental adjustment mechanism includes the first and second posts 908, 910. When a user attaches the band 900 to a body part, the user can insert either the first or second post into a respective opening 912. In one embodiment, the distance D between the first and second posts 908, 910 can be a fraction of the distance D' between two adjacent openings 912. For example, D may be approximately half of the distance of D'. The two posts 910, 912 permit a user to fit the band around a body part (e.g., a wrist) more tightly or loosely compared to the fit obtained with a single post.

Figure 10A:
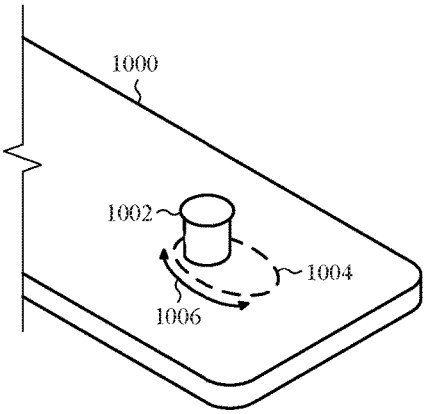
FIGS. 10A-10B show a second incremental adjustment mechanism that is suitable for use with the wearable band shown in FIG. 9.
Figure 10B:
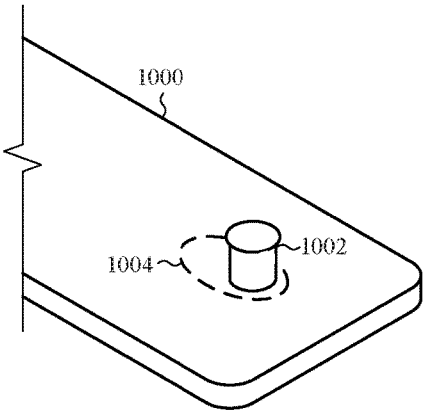

FIGS. 10A-10B show a second incremental adjustment mechanism that is suitable for use with the wearable band shown in FIG. 9. The attachment mechanism includes a post 1002 on a first band segment 1000 and multiple openings formed in a second band segment (not shown). The incremental adjustment mechanism includes the post 1002 mounted on a rotatable elliptical substrate 1004. The rotatable elliptical substrate 1004 can be situated within the first band segment 1000. The rotatable substrate 1004 can having a different shape and/or dimensions in other embodiments.

In some embodiments, the rotatable elliptical substrate 1004 is coupled with a rotating apparatus (not shown) that is configured to permit the rotatable elliptical substrate 1004 to partially rotate and move the post 1002 from one end of the major axis of the elliptical substrate to the other end of the major axis and back again along the same path (e.g., the post only moves along half of the perimeter of the ellipse). In other embodiments, the rotatable elliptical substrate 1004 is coupled with a rotating apparatus (not shown) that is configured to permit the rotatable elliptical substrate 1004 to rotate completely and move the post 1002 from one end of the major axis of the elliptical substrate to the other end of the major axis and back again along the full perimeter of the ellipse.

To incrementally adjust the fit of a band, a user can rotate the post 1002 and the rotatable elliptical substrate 1004 (see arrow 1006) to position the post in a given location and produce a desired band fit. For example, when the post 1002 is positioned as shown in FIG. 10A, and the post 1002 is coupled with an opening in the second band segment, the fit of the band around a body part can be tighter. Conversely, when the post 1002 is positioned as shown in FIG. 10B, the fit of the band around a body part can be looser. In one embodiment, the differences in band length between the two positions can be a fraction of the distance between two openings in the second band segment (e.g., approximately half the distance).

In some embodiments, the material that forms the first and second band segments is a compliant or elastomer material that conforms to the post 1002 when the post 1002 is inserted into an opening in the second band segment regardless of the position of the post 1002. In other words, the post 1002 can be coupled to the same opening when the post 1002 is positioned as shown in FIG. 10A and as shown in FIG. 10B. Additionally, the compliant or elastomer material allows the rotatable elliptical substrate 1004 to rotate, and when positioned at a given location, supports and supplies a holding force to the rotatable elliptical substrate 1004 to counteract any non-user imposed forces and prevent the rotatable elliptical substrate 1004 from rotating to a different position based on the non-user imposed forces. In this manner, the post 1002 is held firmly within the opening and the first band segment 1000 is securely attached to the second band segment.

Figure 11A:
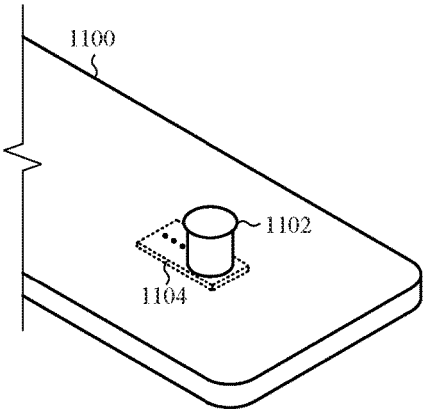
FIGS. 11A-11B show a third incremental adjustment mechanism that is suitable for use with the wearable band shown in FIG. 9.
Figure 11B:
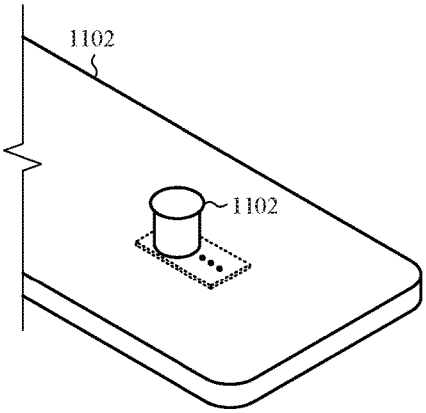

FIGS. 11A-11B show a third incremental adjustment mechanism that is suitable for use with the wearable band shown in FIG. 9. The attachment mechanism includes a single post 1102 slidably affixed to a first band segment 1100 and multiple openings formed in a second band segment (not shown). The incremental adjustment mechanism includes the single post 1102 that slides within region 1104. In one embodiment, the post 1102 can be positioned at one of two given positions (e.g., at the ends of the track 1104 formed in the first band segment 1100). In some instances, the difference in length between the two positions can be a fraction of the distance between two adjacent openings a second band segment (not shown).

For example, in FIG. 11A the post 1102 is positioned in a first position and in FIG. 11B the post 1102 is positioned in a second position by sliding the post 1102 along the track 1104. When the post 1102 is inserted into a respective opening in the second band segment while in the first position (FIG. 11A), the fit of the band around a body part (e.g., a wrist) can be looser because the first position increases the length of the band. Conversely, the fit of the band around a body part can be tighter when the post 1102 is inserted into a respective opening in the second band segment while in the second position (FIG. 11B) because the second position shortens the length of the band.

Alternatively, in another embodiment the post 1102 can be positioned in one of three or more positions within region 1104. In one non-limiting example, the bottom surface of the post 1102 may be a toothed surface that mates with a similarly toothed element within the first band segment 1102. The number of positions the post 1102 can be moved to can be based on the number of teeth in the toothed element or in the toothed surface of the post 1102. A user may pull the post 1102 up to move the post from one position to another position.

In some embodiments, the material that forms the second band segment is a compliant or elastomer material that conforms to the post 1102 regardless of which position the post 1102 is located. In this manner, the post 1102 is held firmly within an opening in the second band segment and the first band segment 1100 is securely attached to the second band segment.

Figure 12:
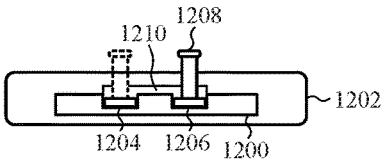
FIG. 12 shows a fourth incremental adjustment mechanism that is suitable for use with the wearable band shown in FIG. 9.

FIG. 12 illustrates a fourth incremental adjustment mechanism that is suitable for use with the wearable band shown in FIG. 9. The attachment mechanism includes a post 1208 connected to a first band segment 1202 and multiple openings formed in a second band segment (not shown). The incremental adjustment mechanism includes a housing 1200 disposed within the first band segment 1202. The housing 1200 includes two indentations or cutouts 1204, 1206. The post 1208 can be moved from one cutout to the other cutout to incrementally adjust the tightness of the band. In one embodiment, the distance between the two cutouts 1204, 1206 can be a fraction of the distance between two adjacent openings in a second band segment (not shown).

To incrementally adjust the fit of a band, a user can pull the post 1208 up so that the post 1208 is lifted out of one cutout. The user may then move or slide the post 1208 to mate with the other cutout. For example, as shown in FIG. 12 the post 1208 can be pulled up and lifted out of the first cutout 1206. The user may then slide the post 1208 along the track 1210 to the second cutout 1204 (post shown in phantom in second cutout). In some embodiments, the material that forms the second band segment is a compliant or elastomer material that conforms to the post 1208 regardless of which cutout 1204 or 1206 the post 1208 is located. In this manner, the post 1208 is held firmly within the opening and the first and second band segments are securely attached to one another. When the post 1208 is inserted into a respective opening in the second band segment while the post 1208 is positioned in one cutout (e.g., the first cutout 1206), the fit of the band around a body part can be looser because the first cutout 1206 increases the length of the band. Conversely, the fit of the band around a body part can be tighter when the post 1208 is inserted into a respective opening in the second band segment while in the post 1208 is positioned in the other cutout (e.g., the second cutout 1204) because the second cutout 1204 shortens the length of the band.

Other embodiments can configure the attachment mechanism differently. For example, a single post can be affixed to a first band segment and multiple openings formed in a second band segment. The incremental adjustment mechanism can include the shape of the post (or the shape of the portion of the post that resides within an opening). The shape is designed to provide one or more incremental adjustments in the fit of the band. In one non-limiting example, the post (or the shape of the portion of the post that resides within an opening) is an elliptical shape that produces at least one incremental adjustment by rotating the post (or the portion of the post that resides within an opening) to one of two different positions. The major axis of the elliptical shape can be positioned parallel with the length of the band for a first band fit, or the major axis of the elliptical shape may be positioned perpendicular to the length of the band for a second fit.

Figure 13:
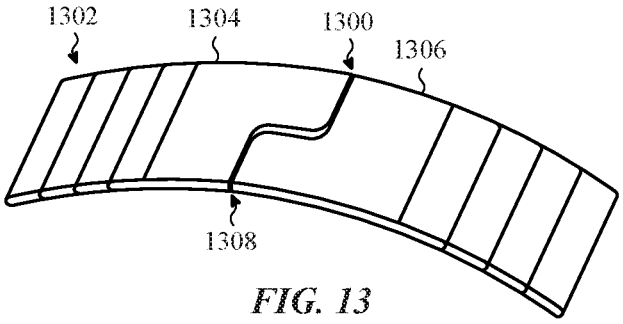
FIG. 13 shows another attachment mechanism in a closed position.
Figure 14A:
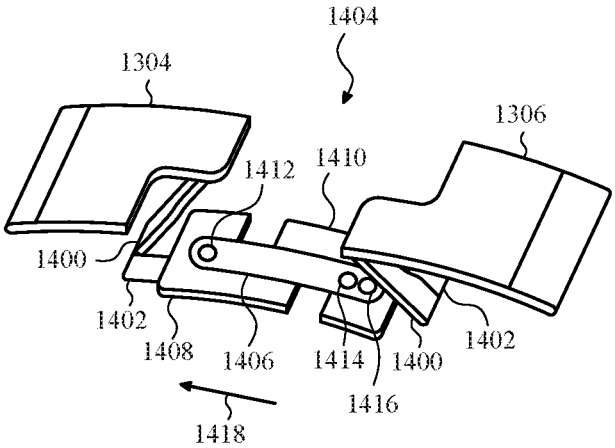
FIGS. 14A-14B show the attachment mechanism of FIG. 13 in a partially open position and in an open position with one example of an incremental adjustment mechanism that is suitable for use with the attachment mechanism.
Figure 14B:
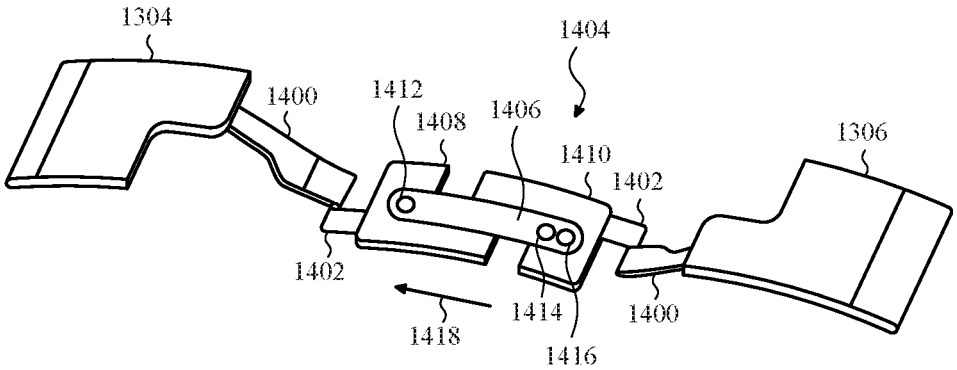

FIG. 13 depicts another attachment mechanism in a closed position. FIGS. 14A-14B show the attachment mechanism of FIG. 13 in a partially open position and in an open position, respectively, with one example of an incremental adjustment mechanism that is suitable for use with the attachment mechanism. The illustrated attachment mechanism 1300 is known as a butterfly clasp. The band 1302 is a continuous band that can include multiple links 1304 connected together. Only a portion of the band 1302 is shown for simplicity. In other embodiments, the band 1302 can be made without links. A band can be made of any suitable material, such as metal or leather.

With respect to FIGS. 13 and 14A-14B, the attachment mechanism 1300 opens to position the band 1302 on a user's body part (e.g., wrist). The user closes the attachment mechanism 1300 to secure to the band on the body part. The attachment mechanism 1300 includes two first wings 1400 that rotate with respect to the second wings 1402 when the attachment mechanism 1300 is opened and closed. The attachment mechanism 1300 can be opened using any suitable method. For example, although not shown in FIGS. 13 and 14, one or two buttons (not shown) can be positioned on the sides of the attachment mechanism 1300 to open the attachment mechanism 1300 when the button(s) are pressed downward or into the sides of the attachment mechanism. FIG. 14A depicts the attachment mechanism in a partially open position. As a user continues to open the attachment mechanism, the attachment mechanism reaches a fully open position as shown in FIG. 14B.

An incremental adjustment mechanism 1404 includes a plate 1406 attached to movable bottom segments 1408, 1410 by inserting one fastener into opening 1412 and another fastener into opening 1414 or opening 1416. The fasteners couple with corresponding openings (not shown) in the bottom segments 1408, 1410. Any suitable fastener can be used. As one example, the fasteners may be screws.

The bottom segment 1410 can include a single opening that is configured to couple with the fastener. The fastener can be inserted into opening 1414 or opening 1416 depending on the desired tightness of the band 1302. Alternatively, the bottom segment 1410 can include one elongated opening that is configured to couple with the fastener regardless of the position of the bottom segment 1410.

In one embodiment, the plate 1406 is removably attached to at least one bottom segment to allow a bottom segment to slide with respect to the other segment. To incrementally adjust the tightness of the band 1302, a user can loosen or remove one or both fasteners in openings 1412 and 1414 (or 1416) to slide one or both bottom segments to incrementally adjust the length of the band. For example, a user can slide segment 1408 in the direction indicated by arrow 1418 to increase the length of the band 1302 (which reduces the tightness of the band 1302). Conversely, sliding the bottom segment 1408 in the opposite direction can decrease the length and increase the tightness of the band 1302. Once the bottom segment(s) 1408, 1410 are each in a particular location that produces a desired band tightness, one or both fasteners can be coupled with the opening 1412 and the opening 1414 or 1416 (and corresponding openings in the bottom segments 1408, 1410) to secure the bottom segments 1408, 1410 in their positions.

Increasing the length of the band 1302 can expand the attachment mechanism 1300 slightly. As shown in FIG. 13, when the length of the band is increased, the top segments 1304, 1306 are separated slightly by a gap 1308. Like the embodiment shown in FIGS. 7 and 8, the gap 1308 may be arranged in an "s" shape to permit the two sub-segments to be co-planar and maintain continuity in the top surface of the two-segments, or the gap 1308 can be arranged in a straight line across the width of the band 1302.

Figure 15:
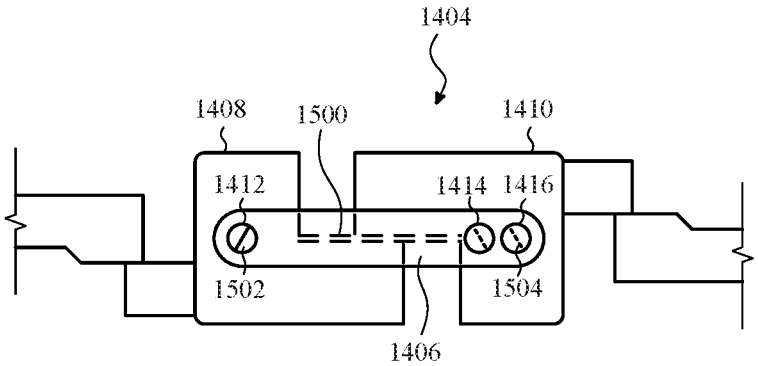
FIG. 15 shows a plan view of the incremental adjustment mechanism shown in FIG. 14.

FIG. 15 illustrates a plan view of the incremental adjustment mechanism shown in FIG. 14. In the illustrated embodiment, the bottom segments 1408, 1410 are coupled together along the path 1500. The coupling of the bottom segments 1408, 1410 is configured to allow at least one bottom segment to slide along the path 1500. Any suitable technique can be used to permit one or both bottom segments to slide. For example, in one embodiment the bottom segments 1408, 1410 can be coupled with a tongue and groove joint.

One or both fasteners 1502, 1504 (e.g., screws) can be loosened or removed to slide at least one segment 1408, 1410 along the path 1500. Once the bottom segments 1408, 1410 are each at a desired position, the plate 1406 can be positioned over and attached to the bottom segments 1408, 1410 with the fasteners 1502, 1504. The fastener 1502 couples with the opening 1412, while the fastener 1504 couples with opening 1414 or with opening 1416 (fastener 1504 shown in phantom).

In the illustrated embodiment, the bottom segment 1410 includes two openings (not shown) that can each couple with the fastener 1504. The locations of the two openings in the bottom segment 1410 correspond to the locations of the openings 1414, 1416. To incrementally adjust the length of the band, a user can remove or loosen the fastener 1504 in one of the openings 1414 or 1416, slide one or both bottom segments 1408, 1410 to a different position, and then affix the fastener 1504 in the other opening. Alternatively, a user can remove both fasteners 1502, 1504 and the plate 1406, slide one or both bottom segments 1408, 1410 to a different position, and then affix the plate 1406 over the bottom segments 1408, 1410 by coupling the fasteners 1502, 1504 in the appropriate openings. The length of the band is increased and the tightness of the band is decreased when the fastener 1504 is in the opening 1416, and the length of the band is reduced and the tightness of the band increased when the fastener 1504 is in the opening 1414.

Other embodiments can configure the incremental adjustment mechanism differently. For example, the incremental adjustment system can include a series of openings that through the sides of both segments 1408, 1410 along path 1500. A removable pin can be inserted into one of the openings to incrementally adjust the length of a band. Alternatively, the bottom segments 1408, 1410 may couple with one plate positioned above the bottom segments and one plate positioned below the bottom segments. The opposing surfaces of the plates (e.g., top of bottom plate and bottom of top plate) can have toothed sections that at least partially mate together. The fasteners 1502, 1504 can be removed or loosened to allow a user to move one plate with respect to the other plate to incrementally adjust the tightness of the band. In such an embodiment, the bottom segment 1410 may include an elongated opening that receives a fastener regardless of the position of the bottom segment 1410, or the bottom plate may include multiple openings that may receive a fastener.

Figure 16:
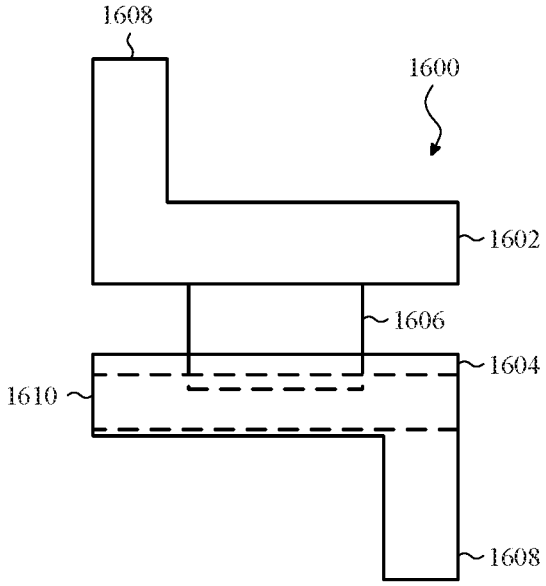
FIGS. 16-17 show a second incremental adjustment mechanism that is suitable for use with the wearable band shown in FIG. 14.
Figure 17:
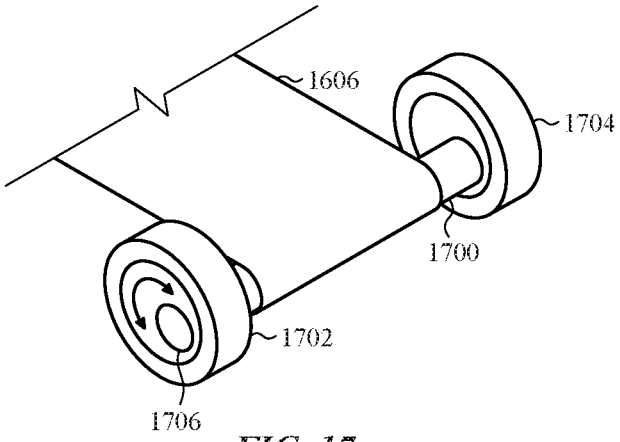

FIGS. 16-17 show a second incremental adjustment mechanism that is suitable for use with the wearable band shown in FIG. 14. Referring to FIGS. 16 and 17, the incremental adjustment mechanism 1600 includes a first bracket 1602 and a second bracket 1604 connected together with a connector 1606. Each outer leg 1608 of the first and second brackets 1602, 1604 connects to the second wings 1402 shown in FIG. 14. The connector 1606 is attached to the first bracket 1602 using any suitable method. For example, the movable connector 1606 can be welded to the first bracket 1602.

The connector 1606 is attached to a shaft 1700 positioned within an opening 1610 in the second bracket 1604. The opening 1610 extends from one side of the second bracket 1604 to the other side of the second bracket 1604. An eccentric cam 1702, 1704 is connected to each end of a connecting bar 1700. The connecting bar 1700 is positioned in the opening 1610 with the eccentric cams 1702, 1704 at each end of the opening 1610. To incrementally adjust the tightness of the band (not shown), the position of the shaft 1700 is rotated, which in turn moves the connector 1606 to adjust the distance between the first and second brackets 1602, 1604. As one example, the shaft 1700 can be rotated by inserting a tool (not shown) into the opening 1706 and rotating the shaft 1700.

Figure 18:
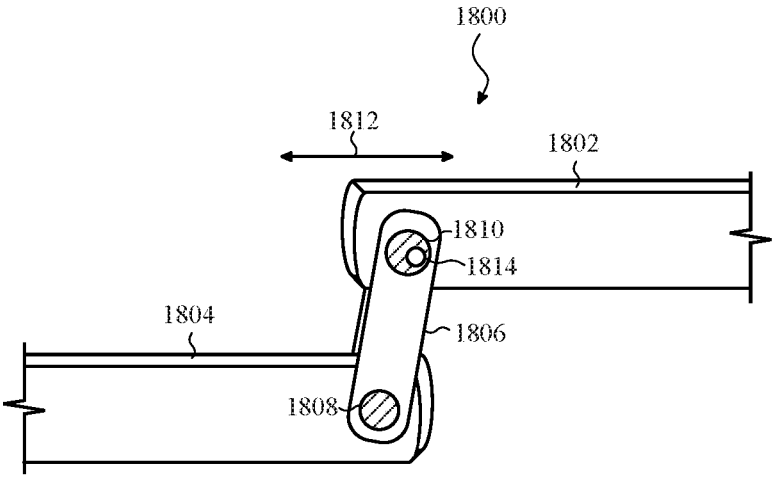
FIG. 18 shows another incremental adjustment mechanism that is suitable for use with the wearable bands shown in FIGS. 7 and 14.

FIG. 18 shows another incremental adjustment mechanism. The incremental adjustment mechanism 1800 includes a first link 1802 operably connected to a second link 1804 via a connector 1806. The incremental adjustment mechanism 1800 is suitable for use with multiple wearable bands, including bands that employ a single deployant clasp and a butterfly clasp. As one example, in the embodiment of FIG. 7, the first link can be the top segment 714, the second link the second wing 708, and the connector the first wing 706.

The connector 1806 attaches to the second link 1804 with a rotatable shaft 1808, and to the first link 1802 with an eccentric cam 1810. The eccentric cam 1810 is configured to move the first link 1802 in the directions indicated by arrow 1812 when the position of the eccentric cam is adjusted. As one example, a tool (not shown) can be inserted into the shaft 1814 to rotate the shaft, 1814, which causes the first link 1802 to move with respect to the second link 1804 in a direction that corresponds to the rotation direction. For example, the first link 1802 moves to the right when the shaft 1814 is rotated clockwise to increase the length of the band and decrease the tightness of the band. Conversely, the first link 1802 moves to the left when the shaft 1814 is rotated counter-clockwise to decrease the length of the band and increase the tightness of the band.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A wearable band configured to couple to an electronic device, comprising:

a first band segment comprising multiple first attachment mechanisms, wherein adjacent pairs of the first attachment mechanisms are separated by a distance;

a second band segment comprising:

a first band sub-segment;

a second band sub-segment movably coupled to the first band sub-segment; and a second attachment mechanism configured to engage one of the multiple first attachment mechanisms and couple the first and second band segments together; and an incremental adjustment mechanism operably connected to at least one of the first band sub-segment and the second band sub-segment and configured to move the first band sub-segment with respect to the second band sub-segment to incrementally adjust a tightness of the wearable band, the first band sub-segment and the second band sub-segment being separated by a gap that is adjustable between a minimum size and a maximum size, the maximum size being smaller than the distance separating the adjacent pairs of the first attachment mechanisms.

2. The wearable band of claim 1, wherein the electronic device comprises a smart watch.

3. The wearable band of claim 1, wherein the incremental adjustment mechanism comprises:

a first toothed edge formed in the first band sub-segment;

a second toothed edge formed in the second band sub-segment opposite the first toothed edge; and a gear configured to rotate between the first and second toothed edges to move the first and second band sub-segments relative to one another.

4. The wearable band of claim 3, wherein a tooth at an end of the first toothed edge is larger than other teeth of the first toothed edge and configured to act as a stop mechanism for the gear.

5. The wearable band of claim 1, wherein:

the first attachment mechanisms comprise openings through the first band segment; and the second attachment mechanisms each comprises a post configured to be inserted into one of the openings.

6. A wearable band configured to couple to an electronic device, comprising:

a first band segment;

a second band segment comprising:

a first band sub-segment; and a second band sub-segment movably coupled to the first band sub-segment;

an attachment mechanism configured to couple the first and second band segments together in one of multiple band segment arrangements to adjust a tightness of the wearable band within a first range; and an incremental adjustment mechanism operably connected to at least one of the first band sub-segment and the second band sub-segment and configured to move the first band sub-segment with respect to the second band sub-segment to adjust the tightness of the wearable band within a second range that is smaller than the first range.

7. The wearable band of claim 6, wherein the electronic device comprises a smart watch.

8. The wearable band of claim 6, wherein the incremental adjustment mechanism comprises:

a first toothed edge formed in the first band sub-segment;

a second toothed edge formed in the second band sub-segment opposite the first toothed edge; and a gear configured to rotate between the first and second toothed edges to move the first and second band sub-segments relative to one another.

9. The wearable band of claim 8, wherein a tooth at an end of the first toothed edge is larger than other teeth of the first toothed edge and configured to act as a stop mechanism for the gear.

10. The wearable band of claim 6, wherein the attachment mechanism comprises:

openings through the first band segment; and a post extending from the second band segment and being configured to be inserted into one of the openings.

* * * * *